US006604800B2

(12) United States Patent
Hamilton

(10) Patent No.: US 6,604,800 B2
(45) Date of Patent: Aug. 12, 2003

(54) REFRIGERATOR SHELVING ASSEMBLY

(75) Inventor: Roger E. Hamilton, Coal Valley, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/022,402

(22) Filed: Dec. 20, 2001

(65) Prior Publication Data

US 2003/0117050 A1 Jun. 26, 2003

(51) Int. Cl.[7] ..... A47B 88/04

(52) U.S. Cl. ..... 312/334.5; 312/336.16; 312/408

(58) Field of Search ..... 312/408, 330.1, 312/333, 332, 334.5, 336.16, 334.7

(56) References Cited

U.S. PATENT DOCUMENTS

| | | | | |
|---|---|---|---|---|
| 1,974,983 A | | 9/1934 | Cook | |
| 3,682,524 A | | 8/1972 | Starace | |
| 3,984,163 A | | 10/1976 | Boorman, Jr. et al. | |
| 4,904,032 A | * | 2/1990 | Jenkins | 312/350 |
| 5,288,046 A | | 2/1994 | Eklof et al. | |
| 5,429,433 A | * | 7/1995 | Bird et al. | 312/408 |
| 5,516,204 A | | 5/1996 | Calvert et al. | |
| 5,660,777 A | | 8/1997 | Herrmann et al. | |
| 5,947,574 A | | 9/1999 | Avendano | |
| 6,045,101 A | | 4/2000 | Goyette et al. | |
| 6,422,673 B1 | * | 7/2002 | Bienick | 312/408 |

* cited by examiner

*Primary Examiner*—Lanna Mai
*Assistant Examiner*—Jerry A. Anderson
(74) *Attorney, Agent, or Firm*—Diederiks & Whitelaw, PLC

(57) ABSTRACT

A refrigerator shelf includes a glass platform having an encapsulating rim which is integrally formed with a pair of downwardly extending wing members, each having a transverse threaded hole formed therein. A projection member, including an elongated shaft having a threaded section spaced from a tip portion, is provided for each wing member. The threaded section is threadably received in the hole of a respective wing member. The shelf is adapted to be slidably supported upon side wall rails of a refrigerator liner, with the tip portion of each projection member extending beneath a respective one of the rails, thereby preventing tipping of the shelf. The tip portion is also adapted to engage structure on the rail in order to limit the permissible degree of sliding movement of the shelf along the rails.

20 Claims, 3 Drawing Sheets

REFRIGERATOR SHELVING ASSEMBLY

BACKGROUND OF THE INVENTION

1. Field of the Invention

The present invention pertains to the art of refrigerators and, more specifically, to a slidable shelving assembly for a refrigerator.

2. Discussion of the Prior Art

It is common to provide vertically adjustable shelves in refrigerator cabinets in order to increase the versatility of storing a wide range of food items. To this end, mainly fresh food compartments of refrigerators have elongated, vertically extending and laterally spaced rails mounted on rear walls thereof, with the rails enabling shelves to be supported in selected vertically adjustable positions in a cantilevered manner. In other arrangements, pegs or rails are attached to or integrally formed with compartment side walls of a refrigerator in order to support shelves thereon. Providing various sets of the pegs or rails at vertically spaced locations along the side walls permits a consumer to vertically reposition a given shelf as desired.

It has also been proposed in the art to enable shelves to be selectively slid partially out of a refrigerator compartment in order to enhance access to food items stored on rear portions of the shelves. Typically, with the case of cantilevered shelves, an overall shelf support frame must be provided to support a shelf both at the rear of the refrigerator compartment and for sliding movement relative to the support frame. In the case of shelves supported along the side walls of a refrigerator compartment, the shelves can relatively easily be enabled to slide directly upon at least side rails.

In supporting a sliding shelf within a refrigerator cabinet, it is necessary to provide structure to limit the permissible degree of sliding movement in order to prevent the shelf from simply sliding right out of the compartment. In the case of cantilevered shelves, this shift limiting structure acts between the shelf and the support frame. In the case of a side wall supported shelf, the shelf will coact either with one or more of the rails or additional structure attached to the respective side wall. In general, a laterally projecting member will be provided below the sliding shelf, with the projecting member abutting another fixed projection on the rail to limit the permissible sliding movement. When a shelf is formed from interconnected wires which generally form an open lattice similar to that employed in connection with oven racks, bent wires are generally located below the rails to define projecting members for limiting the degree of sliding, as well as to prevent tipping of the shelf.

Sliding cantilevered shelving systems almost invariably need to be spaced laterally inwardly from the compartment side walls more than shelves which are actually supported at the side walls. Therefore, shelves which are directly supported at the side walls typically exhibit an advantage in that the shelves can extend substantially the full width of the refrigerator compartment. The lateral spacing between the shelving and the side walls constitutes a zone where any spillage can leak within the refrigerator. To address this potential problem of spillage, it is has become quite common to encapsulate a shelf platform such that a raised peripheral rim is provided. Most typically, a glass shelf platform will be encapsulated about its periphery to advantageously prevent any spilled liquids or the like from running off the shelf. Unfortunately, when employed as full width shelves, such types of shelves have required either rather elaborate brackets and fasteners, or somewhat complicated molding techniques, in order to achieve characteristics corresponding to wire shelves in regards to slide and tip limiting structure.

Based on the above, there exists a need in the art for an improved arrangement for limiting the sliding movement, as well as preventing potential tipping, of a side wall supported, preferably full width, encapsulated shelf for a refrigerator.

SUMMARY OF THE INVENTION

The present invention is directed to an anti-tipping, and preferably slide limiting, arrangement for an encapsulated shelf of a refrigerator. The refrigerator includes a compartment including side walls provided with fore-to-aft extending shelf supporting rails. In accordance with a preferred embodiment of the invention, the encapsulating structure for the shelf is formed with a pair of downwardly extending wing members, each having a transverse, threaded hole formed therein. A projection member, including an elongated shaft having a threaded section spaced from a tip portion, is provided for each wing member. The threaded section is received in the hole of a respective wing member and the tip portion extends beneath a respective one of the rails, thereby preventing tipping of the shelf. The tip portion is also adapted to engage structure on the rail in order to limit the permissible degree of sliding movement of the shelf along the rails.

With this arrangement, an encapsulated shelf is configured with efficient and effective anti-tipping and slide limiting structure which enables the shelf to be easily placed upon and removed from side wall support rails. Therefore, a full width, encapsulated shelf can be advantageously provided in a refrigerator without the need for supplemental brackets and the like. In any event, additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
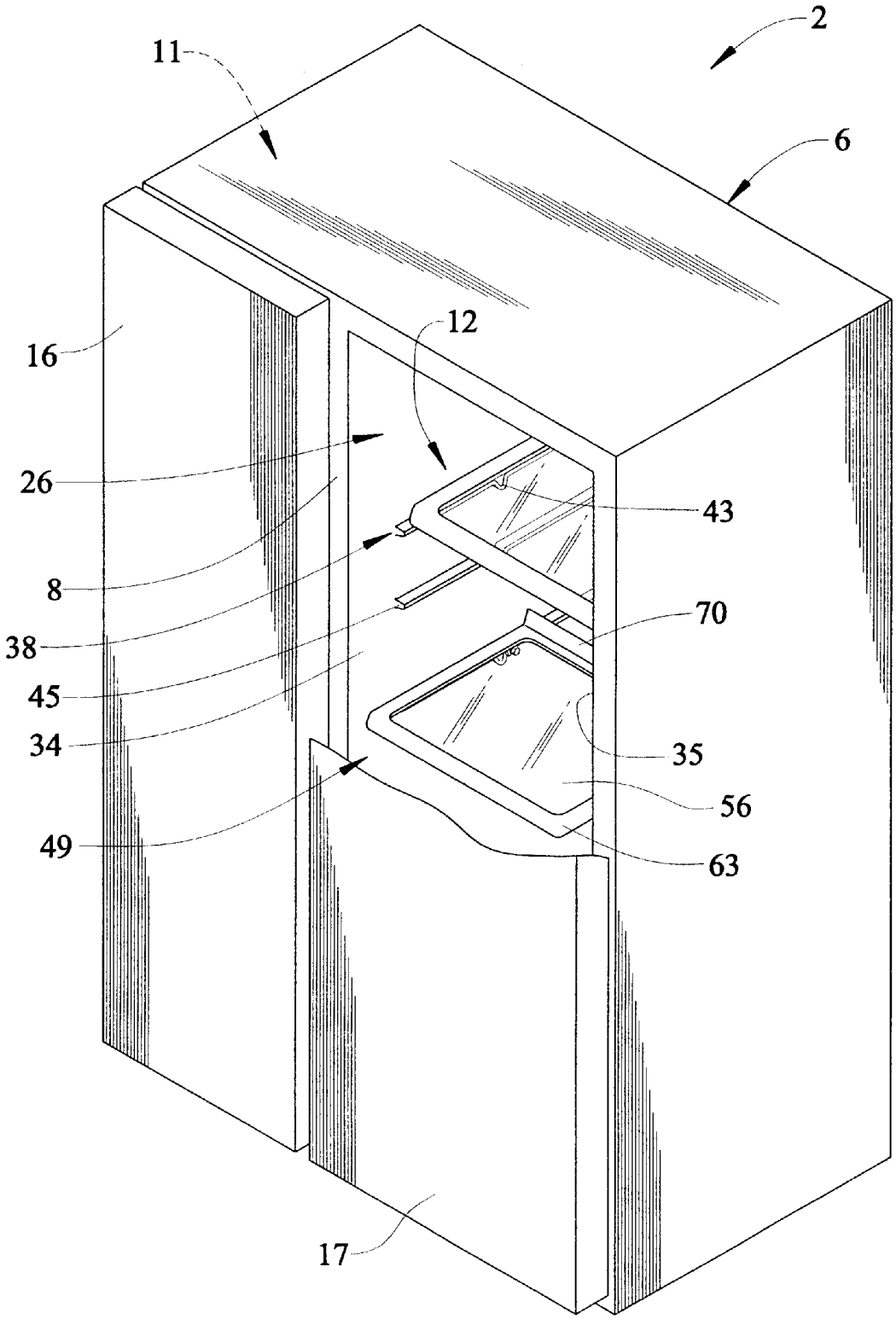
FIG. 1 perspective view of a side-by-side refrigerator having door which is partial cut-away to illustrate internal shelving constructed n accordance with the present invention.

With initial reference to FIG. 1, a refrigerator is generally indicated at 2. Refrigerator 2 includes a cabinet 6 which is divided by a mullion 8 into a freezer compartment 11 and a fresh food compartment 12. In the preferred embodiment shown, refrigerator 2 is constituted by a side-by-side refrigerator. However, as will become more fully evident below, the present invention is equally applicable to other types of refrigerators, such as wherein the freezer and fresh food compartments are vertically disposed relative to one another. As illustrated, freezer compartment 11 can be selectively accessed through a freezer door 16. In a similar manner, fresh food compartment 12 can be selectively accessed through a fresh food door 17, a portion of which is cut-away in FIG. 1 to aid in illustrating aspects of the present invention.

Figure 3:
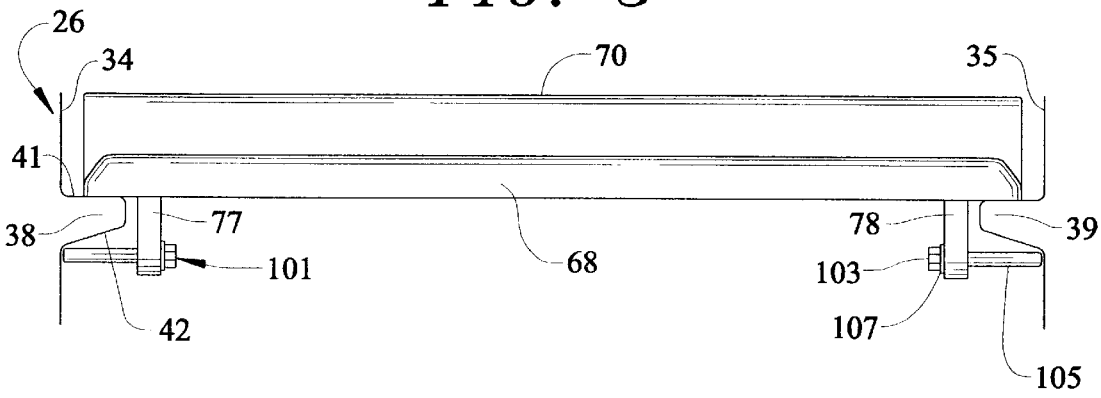
FIG. 3 is a front elevational view of the shelf as mounted upon side wall rails of the refrigerator of FIG. 1.

Fresh food compartment 12 is preferably defined by a liner 26 mounted within cabinet 6. As best shown in connection with FIGS. 1 and 3, liner 26 includes at least side walls 34 and 35. In a manner known in the art, liner 26 is preferably thermoformed. Each of side walls 34 and 35 are preferably provided with various sets of rails 38 and 39, with rails 38 and 39 being arranged on side walls 34 and 35 respectively, while being directly opposite one another. As shown, each rail 38, 39 includes a top rail surface 41 and a bottom rail surface 42. As clearly shown in FIG. 3, top rail surfaces 41 of rails 38 and 39 extend in a substantially common plane. In accordance with the most preferred form of the invention, each set of rails 38 and 39 is integrally formed as part of side walls 34 and 35 during the thermoforming process. Also, each rail 38, 39 preferably includes a stop portion, illustrated at 43 in FIG. 1, which generally depends below bottom rail surface 42 for the reason which will be more fully discussed below. Also, each of rails 38 and 39 include a front end 45.

Figure 2:
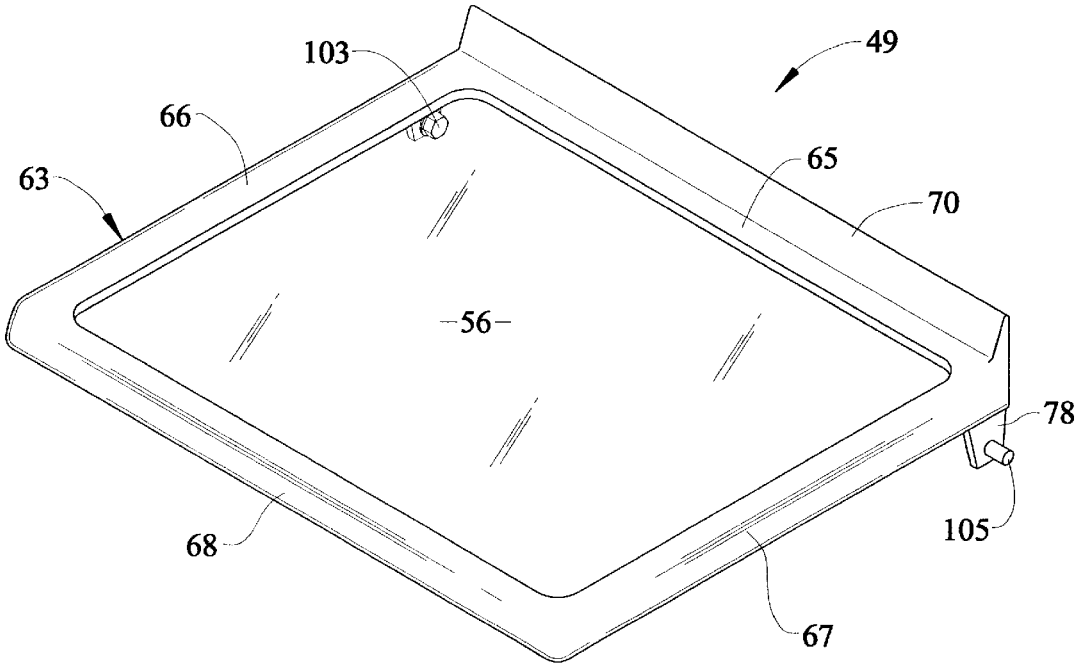
FIG. 2 is a perspective view of a shelf shown in FIG. 1.
Figure 4:
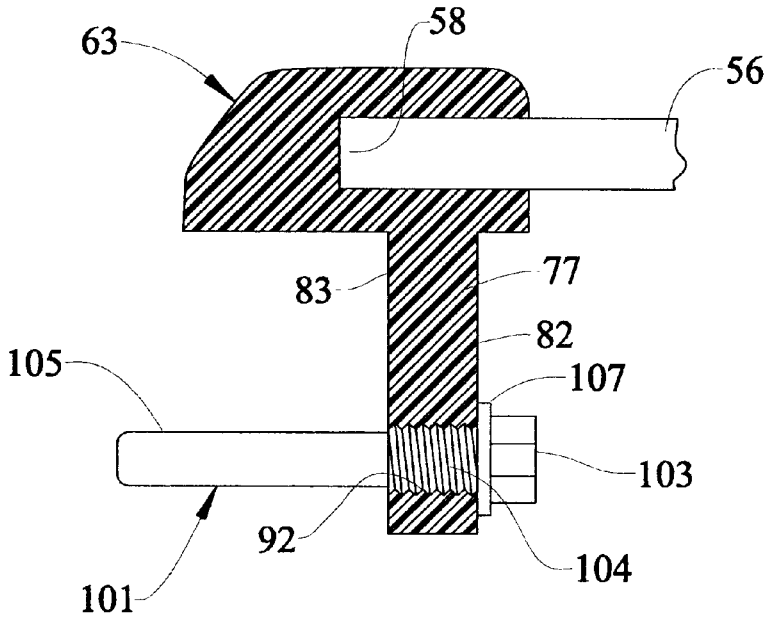
FIG. 4 is a cross-sectional view of a side portion of the shelf of FIG. 2.
Figure 5:
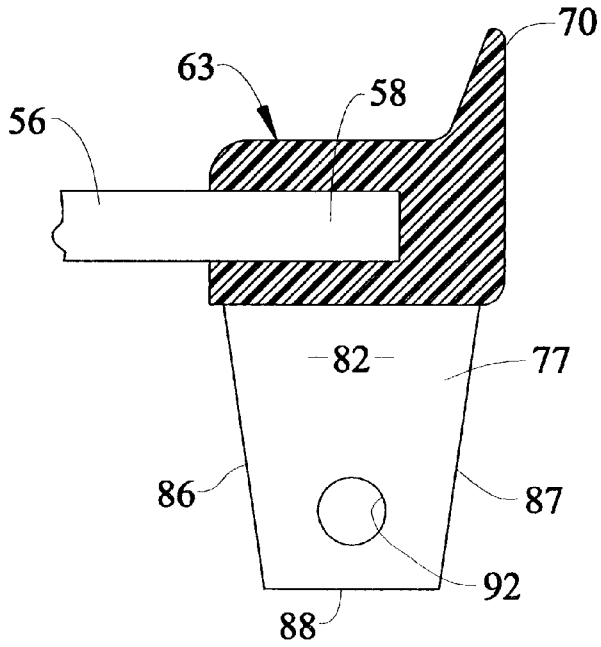
FIG. 5 is a cross-sectional view taken through another portion of the shelf of FIG. 2.

At this point, although rails 38 and 39 are preferably integrally formed with liner 26, it should be noted that the invention is applicable for use in connection with supplemental rails which are separately fastened to side walls 34 and 35, such as through the use of mechanical fasteners or the like. In any event, each set of rails 38 and 39 is adapted to slidably support a shelf which is generally indicated at 49. As perhaps best shown in FIGS. 1 and 2, shelf 49 preferably includes a glass platform 56 having an outer peripheral edge 58 (also see FIGS. 4 and 5). Formed about outer edge 58 is a peripheral rim 63 having a rear portion 65, side portion 66 and 67, and a front portion 68. In accordance with the most preferred embodiment of the invention, peripheral rim 63 also includes an upstanding portion 70 provided at the rearmost section of shelf 49. In a manner known in the art, shelf 49 is formed by molding peripheral rim 63 about glass platform 56 such that at least outer edge 58 is encapsulated by peripheral rim 63. With this construction, peripheral rim 63 protects against any matter spilled upon glass platform 56 from flowing off of shelf 49 and into other portions of fresh food compartment 12.

In general, encapsulated shelving of this type is known in the art. Therefore, the present invention is particularly directed to the manner in which shelf 49 is, while supported upon a selective set of rails 38 and 39, prevented from tipping and limited in sliding movement relative to rails 38 and 39. To this end, with particular reference to FIGS. 2–5, peripheral rim 63 is preferably, integrally formed with a pair of laterally spaced, depending wing members 77 and 78. As shown, each wing member 77, 78 includes an inner side surface 82 and an outer side surface 83. In the most preferred form of the invention, each wing member 77, 78 also includes tapering side walls 86 and 87, as well as a bottom wall 88. More importantly, each wing member 77 and 78 is provided with a through hole 92 which, in accordance with the invention, is internally threaded.

In order to carry out the anti-tipping and stop function of the present invention, a shaft member, generally indicated at 101, is also provided. As shown, shaft member 101 preferably includes a head portion 103, a threaded portion 104 arranged directly adjacent head portion 103, and an elongated tip portion 105 having a substantially smooth outer surface. In accordance with the most preferred form of the invention, head portion 103 also includes an enlarged washer section 107. In any event, threaded portion 104 is preferably arranged directly adjacent head portion 103 and extends for an axial length of shaft member 101 approximate the thickness of an associated wing member 77, 78. As perhaps best illustrated in FIG. 4, shaft member 101 is adapted to be received within a respective hole 92 with tip portion 105 extending freely through hole 92 and threaded portion 104 being threadably engaged within hole 92. Head portion 103 is provided to enable tightening of shaft member 101 through the use of any one of various conventional tools.

As shown, wing members 77 and 78 preferably project downward from and are integrally formed with side portions 66 and 67 respectively, preferably directly adjacent rear portion 65. When shelf 49 is installed within fresh food compartment 12, side portions 66 and 67 of peripheral rim 63 rest upon a respective set of rails 38 and 39 as clearly shown in FIG. 3. Shelf 49 preferably constitutes a full width shelf in that there is really only a small lateral gap between side portions 66 and 67 of peripheral rim 63 and the respective side walls 34 and 35 in order to enable shelf 49 to be selectively slid into and out of fresh food compartment 12. In any event, more importantly, wing members 77 and 78 project downward from peripheral rim 63 at a position spaced laterally inwardly of rails 38 and 39. In addition, wing members 77 and 78 project downward from peripheral rim 63 below bottom rail surface 42. When shelf 49 is supported upon rails 38 and 39, shaft member 101 can be placed in hole 92 of a respective wing member 77, 78, with tip portion 105 projecting laterally outwardly from the wing member 77, 78 so as to extend below a respective rail 38, 39. When each shaft member 101 is tightened, tip portion 105 is preferably only slightly spaced from liner 26. In this manner, the shaft members 101 cooperate to prevent lateral shifting of shelf 49 during sliding movement of shelf 49 upon rails 38 and 39.

If shelf 49 is front loaded with various food items placed on glass platform 56 adjacent front portion 68 and shelf 49 is slid at least partially out of fresh food compartment 12 for easy access to the food items, there would be a tendency of shelf 49 to tip over. However, with shaft members 101 projecting beneath rails 38 and 39, shelf 49 is prevented from tipping. In addition, as shelf 49 is slid forward, one or more of shaft members 101 can cooperate with a stop portion 43 of a respective rail 38, 39 to limit the permissible forward movement of shelf 49 relative to liner 26. Removal of shelf 49 for adjustability or cleaning purposes can be readily carried out by the consumer by simply removing shaft members 101.

With this overall arrangement, an encapsulated shelf can be advantageously supported upon side walls of a refrigerator compartment while be integrally formed with structure that readily receives simple mechanical attachment elements that can perform various functions, particularly anti-tipping and shift limiting functions. This overall arrangement advantageously avoids the need for any complicated brackets or the like which would have to be separately attached to shelf structure in order to perform a similar function. Instead, various wing members can be easily, integrally molded when forming the overall shelf and the consumer is only required to perform a simple mechanical task with the use of a standard tool, such as a wrench or ratchet, when changes to the overall shelving system for the refrigerator is desired. In any event, although described with reference to a preferred embodiment of the invention, it should be readily understood that various changes and/or modifications can be made to the invention without departing from the spirit thereof. In general, the invention is only intended to be limited by the scope of the following claims.

I claim:

1. A refrigerator comprising:

a cabinet shell;

a liner disposed in the cabinet shell, said liner including opposing, fore-to-aft extending, side walls defining, at least in part, a food storage compartment;

at least first and second rails extending fore-to-aft across the opposing side walls respectively, said first and second rails including top surfaces extending in a substantially common plane; and a shelf including a platform, a peripheral rim extending about at least a portion of the platform, at least one wing member depending from the peripheral rim, and a shaft member, said shelf being slidably supported upon the first and second rails with the at least one wing member extending below the top surface of one of the first and second rails, said shaft member being movably attached to the at least one wing member to shift said shaft member, relative to said at least one wing member, beneath the top surface of said one of the first and second rails to limit tipping of the shelf.

2. The refrigerator according to claim 1, wherein the at least one wing member includes a transverse hole, said shaft member extending through said hole.

3. The refrigerator according to claim 2, wherein said hole is internally threaded and said shaft member includes an externally threaded section, said threaded section of the shaft member being threadably attached within the hole for connecting the shaft member to the at least one wing member.

4. The refrigerator according to claim 3, wherein the shaft member further includes a head portion and a tip portion, said threaded section being located between the head portion and the tip portion.

5. The refrigerator according to claim 4, wherein the tip portion has a substantially smooth outer surface.

6. The refrigerator according to claim 3, wherein the platform is made of glass which is encapsulated by the peripheral rim, said peripheral rim being made of plastic.

7. The refrigerator according to claim 6, wherein said at least one wing member includes first and second wing members extending below and being integrally formed with the peripheral rim.

8. The refrigerator according to claim 7, wherein the first and second wing members are located directly adjacent a rear portion of the shelf.

9. The refrigerator according to claim 7, wherein the first and second wing members are located laterally inwardly of an outermost edge of the platform.

10. The refrigerator according to claim 1, wherein each of the first and second rails are integrally formed with the liner.

11. The refrigerator according to claim 1, wherein said one of the first and second rails is formed with an integral stop member, said shaft member being adapted to abut the stop member to limit a permissible degree of shifting of the shelf upon the first and second rails.

12. A refrigerator shelf comprising:

a platform;

a peripheral rim extending about at least a portion of the platform;

at least one wing member depending from the peripheral rim; and a shaft member, said shelf being adapted to be slidably supported upon first and second side wall rails within a refrigerator compartment, with the at least one wing member extending below a top surface of one of the first and second rails, said shaft member being movably attached to the at least one wing member and being adapted to shift, relative to said at least one wing member, beneath the top surface of one of the first and second rails to limit tipping of the shelf.

13. The refrigerator shelf according to claim 12, wherein the at least one wing member includes a transverse hole, said shaft member extending through said hole.

14. The refrigerator shelf according to claim 13, wherein said hole is internally threaded and said shaft member includes an externally threaded section, said threaded section of the shaft member being threadably attached within the hole for connecting the shaft member to the at least one wing member.

15. The refrigerator shelf according to claim 14, wherein the shaft member further includes a head portion and a tip portion, said threaded section being located between the head portion and the tip portion.

16. The refrigerator shelf according to claim 15, wherein the tip portion has a substantially smooth outer surface.

17. The refrigerator shelf according to claim 14, wherein the platform is made of glass which is encapsulated by the peripheral rim, said peripheral rim being made of plastic.

18. The refrigerator shelf according to claim 17, wherein said at least one wing member includes first and second wing members extending below and being integrally formed with the peripheral rim.

19. The refrigerator shelf according to claim 18, wherein the first and second wing members are located directly adjacent a rear portion of the shelf.

20. The refrigerator according to claim 18, wherein the first and second wing members are located laterally inwardly of an outermost edge of the platform.

* * * * *